US005163213A

United States Patent [19]

Brizendine

[11] Patent Number: 5,163,213

[45] Date of Patent: Nov. 17, 1992

[54] HYDRAULICALLY RETROFITTING MECHANICALLY ADJUSTABLE CONE CRUSHERS

[76] Inventor: Julian F. Brizendine, 2170 Five Mile Line Rd., Penfield, N.Y. 14526

[21] Appl. No.: 786,823

[22] Filed: Nov. 1, 1991

[51] Int. Cl.[5] ..... B21K 21/16; B02C 2/04

[52] U.S. Cl. ..... 29/401.1; 241/215

[58] Field of Search ..... 29/401.1, 428; 241/207-216, 286, 290

[56] References Cited

U.S. PATENT DOCUMENTS

| | | | |
|---|---|---|---|
| 2,684,208 | 7/1954 | Werner | 241/207 |
| 2,718,358 | 9/1955 | Burls | 241/207 X |
| 3,133,708 | 5/1964 | Bond et al. | 241/207 X |
| 3,759,453 | 9/1973 | Johnson | 241/207 |
| 3,834,633 | 9/1974 | Dougall et al. | 241/207 X |
| 4,615,491 | 10/1986 | Batch et al. | 241/207 X |
| 4,717,084 | 1/1988 | Vendelin et al. | 241/207 |

OTHER PUBLICATIONS

Power Team Maintenance Tools & Equipment for Industry, No. PT90, p. 1.

Hydraulic Clamping & Adjustment-Field Conversion, p. 3-1.

*Primary Examiner*—Timothy V. Eley

*Attorney, Agent, or Firm*—Cumpston & Shaw

[57] ABSTRACT

A method for retrofitting a mechanically adjustable cone crusher which comprises removing each adjustment cap screw or locking post of the bowl asssembly and placing a hydraulic cylinder which contains a center hole under the head of each adjustment cap screw or locking post. This is followed by inserting said cap screw or locking post shaft through the center hole of said hydraulic cylinder, to its original position in the threaded bore of the bowl assembly, and adjusting the bowl assembly, followed by providing positive clamping action through the use of said hydraulic cylinders.

8 Claims, 3 Drawing Sheets

HYDRAULICALLY RETROFITTING MECHANICALLY ADJUSTABLE CONE CRUSHERS

BACKGROUND OF THE INVENTION

The present invention is directed to a method and system of retrofitting conventional mechanical standard lock posts or adjustment cap screws which are used to clamp the bowl assembly of a cone crusher. In the prior art, mechanically adjustable cone crushers require periodic inspection for bowl looseness and are susceptible to possible damage caused by bowl movement during operation.

In order to eliminate the above problem, certain high profile hydraulic locking post assemblies are available which can be used to retrofit mechanically adjustable and clamped cone crusher assemblies. Because of the high profile of these hydraulic assemblies, the feed or stone cage must be distanced at a significant height to avoid contact with hydraulic hardware, resulting in significant abrasion to crusher parts caused by the stone falling at a greater height than normal into the crusher. These high profile hydraulic locking post assemblies are also extremely expensive to purchase and install.

There is, therefore, a need in the art for a simpler, less expensive system for retrofitting cone crushers which overcomes the problems noted above.

SUMMARY OF THE INVENTION

The present invention is directed to retrofitting conventional mechanical standard lock posts or adjustment cap screws which are used to clamp the bowl assembly of a cone crusher. The invention more specifically involves modifying these mechanically adjusted units with a unique hydraulic clamping system. In the present invention a specially designed low profile hydraulic cylinder, having a center hole to accommodate a shaft of a cap screw or locking post, is powered by a conventional electric hydraulic pump. The cylinder is inserted under the head of each adjustment cap screw or locking post, contained on the bowl assembly of the cone crusher. The hydraulic cylinders, typically six in number, are connected in series with a hydraulic hose and powered by an electric hydraulic pump to provide for automatic clamping of the bowl assembly, with all of the adjustments being made and monitored through the use of an electrically powered hydraulic unit and system. Positive clamping of the bowl assembly is automatically maintained by the hydraulic cylinders which are regulated and controlled by a conventional electric pressure switch. Use of the cylinders in conjunction with the novel system of the present invention provides a low profile cylinder which allows mechanically controlled cone crushers to be retrofitted from mechanical to hydraulic without changing any of the original parts, including accommodating the original adjustment bolts or locking posts. The low profile cylinders allow for close proximity of the stone cage which reduces abrasion and wear and tear on the falling stone feed into the crusher, unlike the existing high profile of the prior art hydraulics. Because of the prior art high profile hydraulics which must be distanced a greater height from the stone cage to avoid contact with the hydraulic hardware, significant abrasion is caused in these systems by the stone falling at a greater height into the crusher. When in place on a retrofitted cone crusher, the system of the present invention results in a savings in manpower, is cost effective, results in less down time and allows for faster adjustment and clamping of the bowl on existing mechanically adjustable cone crushers.

DETAILED DESCRIPTION OF THE INVENTION

Cone crushers are commonly used to crush various feed in the form of raw material such as stone, ore and a wide variety of minerals through the gyrating action of the crusher. The raw material or feed to be sized is crushed through the gyrating action of the cone crusher in the space formed by the crusher mantle and bowl liner of the crusher. Cone crushers are well known in the art and a sectional view of a mechanically adjustable cone crusher 10 is illustrated in FIG. 1 of the drawings.

Figure 1:
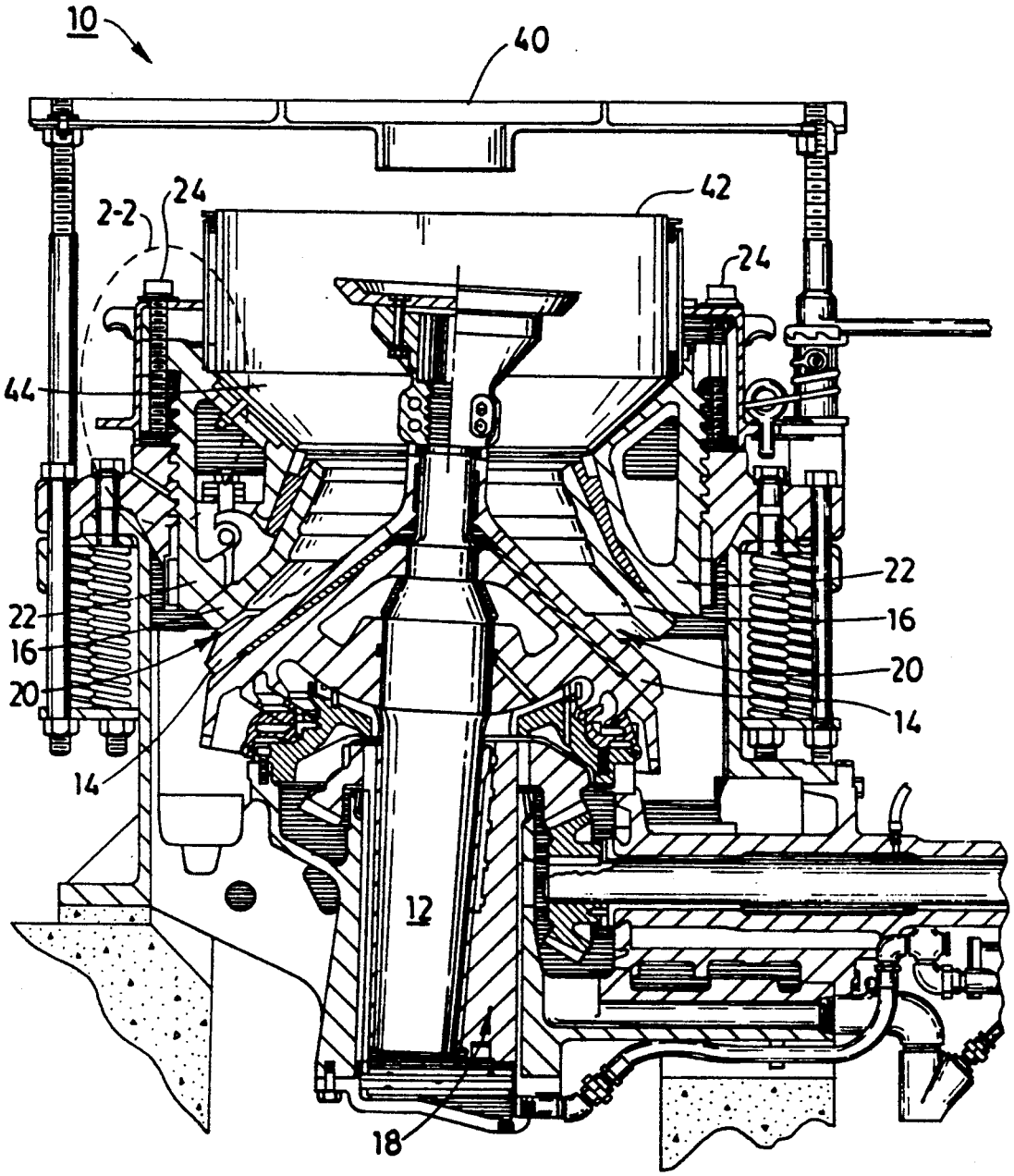
FIG. 1 PRIOR ART
FIG. 1 illustrates a front cross-sectional view of a prior art mechanically adjustable cone crusher.

In FIG. 1 crushing is caused by the eccentric or gyrating action of the main shaft 12 which causes a crushing motion by the mantle 14 against the stationary inner surface of the bowl liner 16 of the crusher. The main shaft 12 spins within a turning eccentric mechanism 18 which is powered by conventional means well known in the art. The mantle 14 which is attached to the upper portion of the main shaft spins in a gyrating manner and crushes the feed, such as stone, between the space 20 formed between the moving mantle and the stationary bowl liner 16 of bowl 22. The feed, such as stone, passes from a feed platform or cage 40 into the feed hopper 42 through the feed cone 44 and into the inside of the bowl 22 where it is crushed by the operating action of the moving mantle against the stationary bowl liner.

Figure 2:
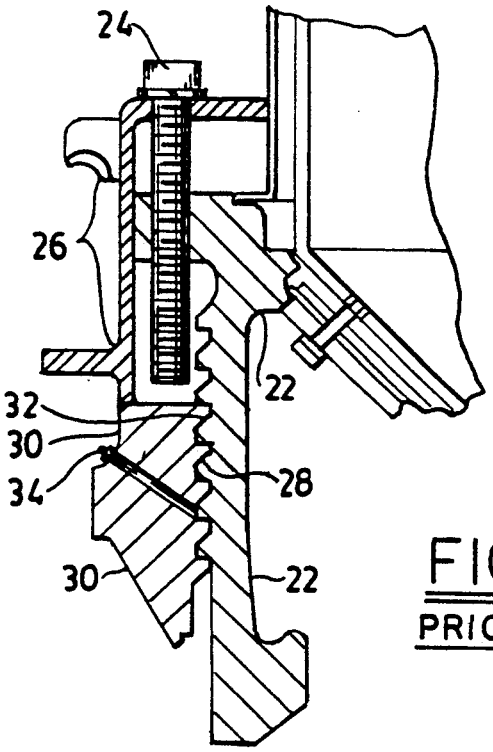
FIG. 2 PRIOR ART
FIG. 2 illustrates an enlargement the section 2—2 of FIG. 1.

In a mechanically adjusted cone crusher, standard mechanical lock posts or adjustment cap screws or any other suitable clamping means are used to clamp the bowl assembly of the cone crusher. The adjustment cap screw 24, which is used to illustrate the invention, (FIGS. 1 and 2), which passes through the adjustment cap 26, and is threaded to bowl 22, functions to tighten or clamp the bowl threads 28 to the threads 32 of adjustment ring 30 to maintain the bowl and bowl liner stationary during the crushing action of the crusher. A grease hole 34 to provide lubricant to the threads is contained in adjustment ring 30. The combination of the adjustment cap screw, adjustment cap, bowl and bowl liner are commonly referred to as the bowl assembly. An adjustment lock post is equivalent to an adjustment cap screw. It has the same threaded shaft except that instead of a conventional screw head, the head of the lock post is slotted to receive a taper key which functions as the equivalent of the screw head when used in the present invention.

The detailed operation and maintenance of the crusher illustrated in FIG. 1, and equivalent devices, are described in detail in the *Symons Cone Crusher Instruction Manual For Standard and Short Head Models* (7th Printing), Process Machinery Division, Milwaukee, Wis., which is incorporated herein by reference. For example, see page 11-7 for more detail on the lock post and the drawing of the 4¼ standard General Assembly (standard seal-typical arrangement) for 3 ft. and 4 ft. standards) which is the support for FIG. 1 above.

Figure 3:
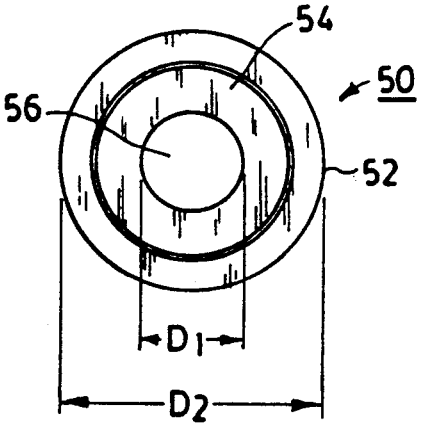
FIG. 3 illustrates a top view of a low profile hydraulic cylinder used in the present invention.
Figure 4:
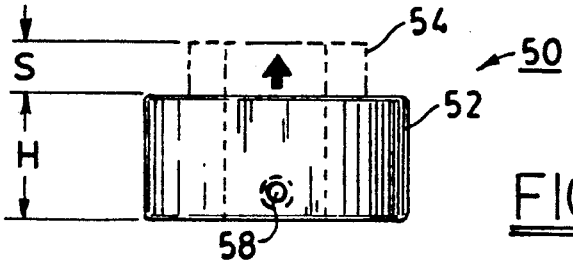
FIG. 4 illustrates a side view of the hydraulic cylinder of FIG. 3.
Figure 5:
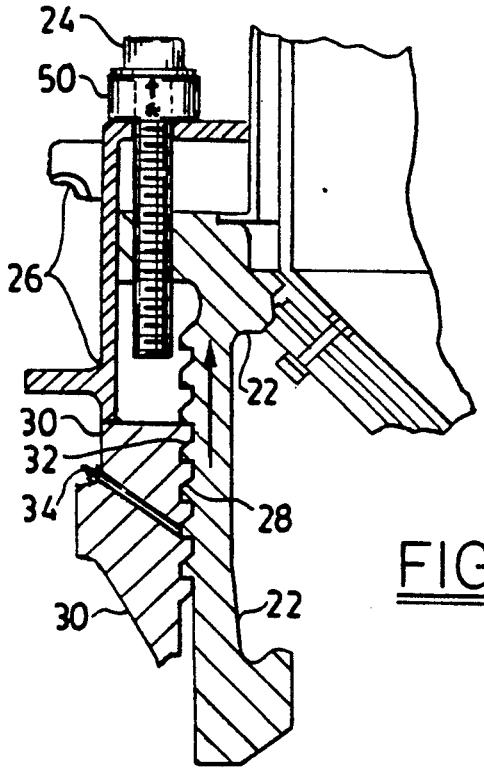
FIG. 5 illustrates the use of the hydraulic cylinders of the present invention in the clamping position under the adjustment cap screw of a retrofitted mechanically adjustable cone crusher.

In the present invention a specially designed low profile hydraulic cylinder having a central hole or bore, which is powered by a conventional electric hydraulic pump (not shown), is inserted under the head of each adjustment cap screw contained on the bowl assembly of the cone crusher. This arrangement is more clearly shown in FIG. 5. The hydraulic cylinders 50 used in the present invention may comprise any hydraulic cylinder of the type sold by OTC Power Team Division and illustrated in their *Maintenance Tools & Equipment For Industry Catalog*, No. PT90, published 1990, OTC Power Team Division, SPX Corporation, Owatonna, Minn. (see page 20) which is incorporated herein by reference. These cylinders have been modified only in their external configuration to provide a low profile in order to gain the advantages of the present invention. By low profile is meant that the diameter D2 of the cylinder is preferably greater than the height H. The hydraulic cylinders 50 used in the present invention are illustrated in FIGS. 3 and 4 of the drawings in which the cylinder comprises an outer cylinder body 52, a moveable piston rod 54 having a stroke or travel distance S, a central cylindrical hole 56 having a diameter D1 suitable for mounting around the shaft of an adjustment cap screw or lock post, and a coupler or connection 58 suitable for hook up in series to suitable conventional hydraulics.

In the present invention, the hydraulic cylinders for use on a crusher of the type illustrated were 6 inches in diameter, having a 2¼ inch center hole, a height of 2⅞ inches, with a piston stroke of 1¼ inches. The cylinders have a capacity of 11 tons. It should be understood the size and capacity of the cylinder can be modified to the requirements of the crusher being retrofitted.

Figure 6:
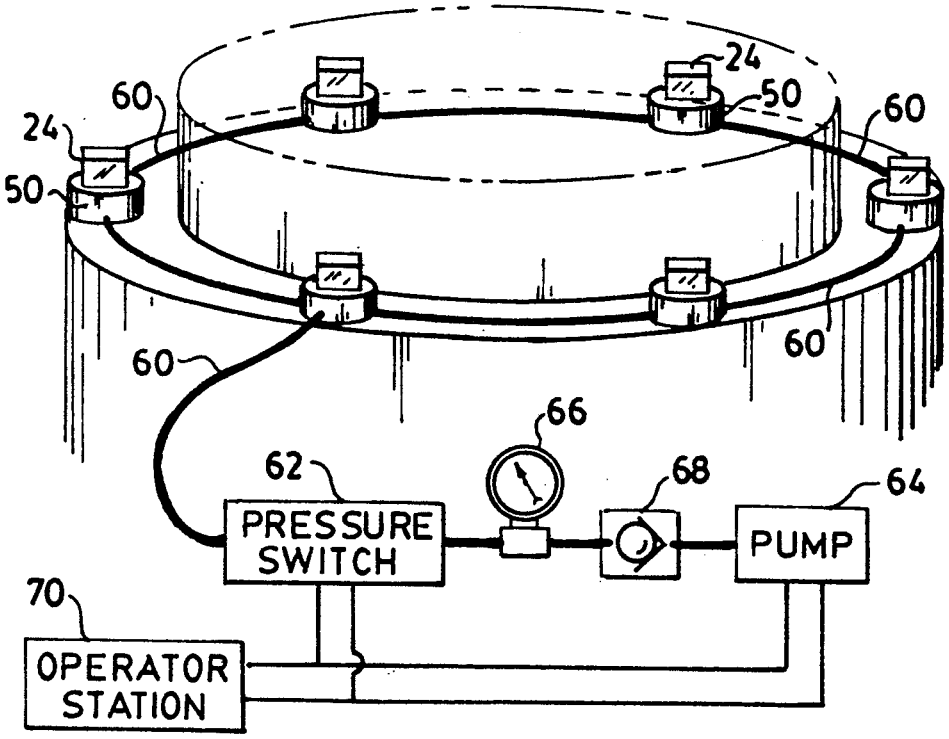
FIG. 6 is a schematic illustration of the present invention illustrating the use of the hydraulic cylinders of the present invention in clamping the bowl of a cone crusher.

Referring to FIG. 6, there is illustrated in schematic form the means used to control the operation of the system and method of the present invention. A plurality of hydraulic cylinders 50 are fluidly connected in series by a hydraulic hose 60. The hydraulic cylinders are also fluidly connected to a pressure switch 62. The pressure switch 62 is fluidly connected to pump 64 through a pressure gauge 66 and a pressure relief and check valve 68. The pump 64 provides the necessary pressure needed to operate hydraulic cylinders 50. The pressure relief and check valve 68 is used to release the pressure in the hydraulic cylinders when they are exerting clamping pressure so that the operator can adjust the bowl within the adjustment ring threads to maintain the proper clearance between the bowl liner and mantle for crushing. The pressure gauge 66 allows the operator to monitor the pressure of the fluid being supplied to the cylinders. The operation of pressure switch 62 and pump 64 are controlled at an operator station 70 by suitable controls available in the art. In the embodiment illustrated, the operator station is electrically connected to the pump and pressure switch so as to control operation from a selected location as is commonly done in the art.

Positive clamping of the bowl is automatically maintained by the hydraulic cylinders through contact and pressure of piston rod 54 of cylinder 50 against the underside of the head of adjustment cap screw 24 (see directional arrow in FIG. 5), which is regulated and controlled by the electric pressure switch. Valve 68 contains a manual pressure relief means which releases clamping pressure on the hydraulic cylinders when adjustments are being made. When the adjustment is completed, the valve is restored to its original position and clamping pressure is automatically reapplied. The cylinders operate in a pressure range of about 2,100 to 2,400 psi. Since the clamping pressure through this method is uniform and automatically sustained, no periodic inspections for bowl looseness are necessary. Furthermore, damage commonly caused by bowl movement during operation is virtually eliminated.

It should be understood that all of the components illustrated in FIG. 6 are readily available state of the art devices which are commonly used to control and operate hydraulic cylinders and systems. For example, the electric hydraulic pump, pressure switch, valve and gauge are commonly available and shown in the previously referred to *Maintenance Tools & Equipment For Industry Catalog*, No. PT90, published 1990, OTC Power Team Division, SPX Corporation, Owatonna, Minn. which is incorporated herein by reference.

While the invention has been described in detail with respect to specific embodiments thereof, it will be understood by those skilled in the art that variations and modifications may be made without departing from the essential features thereof.

What is claimed is:

1. A method for retrofitting a mechanically adjustable cone crusher which includes an adjustable bowl assembly having a bowl liner, with said bowl assembly being held in position by a plurality of adjustment cap screws or locking posts each including a head and a threaded shaft, wherein the threaded shaft cooperatively engages a threaded bore of the bowl assembly, said method comprising:

(a) removing each adjustment cap screw or locking post;

(b) placing a hydraulic cylinder which contains a center hole under the head of each adjustment cap screw or locking post;

(c) inserting each cap screw or locking post shaft through the center hole of said hydraulic cylinder, and cooperatively engaging the threaded shaft with the threaded bore of the bowl assembly; and (d) adjusting the bowl assembly to provide proper clearance of the bowl liner during crushing, followed by providing positive clamping action against the underside of the screw or post head through the use of said hydraulic cylinders.

2. A method of claim 1 in which the hydraulic cylinders are controlled by an electric hydraulic pump.

3. A method of claim 2 in which said pump is incorporated in a system which includes a pressure gauge, pressure switch, shut off valve and connecting hydraulic hose fittings which connect each hydraulic cylinder in series to allow the bowl assembly clamping pressure to be automatically sustained.

4. The method of claim 1 in which the hydraulic cylinders have a low profile whereby the cylinder has a diameter which is greater than the height of said cylinder.

5. The method of claim 4 in which the height of the cylinder is three inches or less.

6. The method of claim 5 in which the diameter of the cylinder is at least about six inches.

7. A method for retrofitting a mechanically adjustable cone crusher which includes an adjustable bowl assembly having a bowl liner, with the bowl assembly being held in position by a plurality of mechanical adjustment and clamping means each containing a stop or head and a threaded shaft, respectively, each of which is contained in a threaded bore of the bowl assembly, said method comprising:

(a) removing each threaded mechanical adjustment and clamping means from the bowl assembly;

(b) placing a low profile hydraulic cylinder containing a center hole under the stop or head of each mechanical adjustment and clamping means;

(c) inserting the threaded shaft of each mechanical adjustment and clamping means through a center hole of said hydraulic cylinder to its position in the threaded bore of the bowl assembly; and (d) adjusting the bowl assembly, followed by providing positive clamping action against the underside of the stop or head of said mechanical adjustment and clamping means through the use of said hydraulic cylinders.

8. The method of claim 7 in which the adjustment and clamping means comprise an adjustment cap screw or a locking post.

* * * * *